US005716128A

United States Patent [19]

Clark et al.

[11] Patent Number: 5,716,128

[45] Date of Patent: Feb. 10, 1998

[54] POWER TAKEOFF AND LIGHTING UNIT FOR FLUORESCENT FIXTURE

[75] Inventors: Gregory M. Clark, Westport; Neil M. Brown, Weston; John E. Pfeifer, Redding; Kenneth J. Galer, Brookfield, all of Conn.

[73] Assignee: Markson Rosenthal & Co., Englewood Cliffs, N.J.

[21] Appl. No.: 668,726

[22] Filed: Jun. 24, 1996

[51] Int. Cl.[6] ..... F21S 3/00

[52] U.S. Cl. ..... 362/221; 362/225; 362/260

[58] Field of Search ..... 362/226, 221, 362/260, 225

[56] References Cited

U.S. PATENT DOCUMENTS

| | | | |
|---|---|---|---|
| Re. 30,367 | 8/1980 | Belokin, Jr. | 339/50 R |
| 3,582,866 | 6/1971 | Johnson et al. | 339/50 |
| 3,993,386 | 11/1976 | Rowe | 339/50 R |
| 4,144,462 | 3/1979 | Sieron et al. | 307/66 |
| 4,211,958 | 7/1980 | Bickford et al. | 315/312 |
| 4,218,106 | 8/1980 | Belokin, Jr. | 339/32 R |
| 4,511,200 | 4/1985 | Belokin, Jr. | 339/50 R |
| 4,682,079 | 7/1987 | Sanders et al. | 315/186 |
| 4,912,371 | 3/1990 | Hamilton | 315/95 |
| 5,118,302 | 6/1992 | Fussell et al. | 439/225 |

*Primary Examiner*—Stephen F. Husar

*Attorney, Agent, or Firm*—St. Onge Steward Johnston & Reens LLC

[57] ABSTRACT

A power takeoff and lighting unit for a fluorescent fixture is disclosed and comprises an elongate housing having spaced apart connectors on opposite ends for connection to a standard fluorescent lighting fixture. The housing includes a first segment containing electronics for converting power to usable power, such as direct current, and has a power cord that extends outwardly from the segment. Preferably, the unit has a maximum diameter less than twice the diameter of a standard fluorescent tube, and preferably less than 1½ times the diameter of a standard fluorescent tube, thus providing a compact profile and enabling modular replacement of a standard bulb with the power takeoff lighting unit.

21 Claims, 5 Drawing Sheets

POWER TAKEOFF AND LIGHTING UNIT FOR FLUORESCENT FIXTURE

FIELD OF THE INVENTION

The invention relates to power takeoff devices for fluorescent fixtures and, more specifically, to devices for providing takeoff power while maintaining lighting and to devices for taking off power for point-of-purchase (POP) displays.

BACKGROUND OF THE INVENTION

In many commercial real estate spaces, it is desirable to power point-of-purchase displays (POP displays) in locations throughout a store. Stores typically have long aisles that are lighted with fluorescent bulbs on the ceiling above shelving adjacent to the aisle. Since the POP displays are moved and replaced frequently, it is necessary to provide power in various locations. A ready source of power is the fluorescent lighting that is immediately above the aisles and shelves, but it is necessary to take off power from these bulbs in a safe and aesthetically pleasing manner.

With respect to aesthetics, the fluorescent bulbs are often located inside fixtures which have grates or lenses located immediately below the bulbs and in close proximity to the bulbs. Thus, there is not a lot of room to fit a takeoff apparatus inside the lighting fixture itself. U.S. Pat. No. RE30,367 discloses a power takeoff from a fluorescent light fixture wherein a housing is located below the lighting fixture. This type of system is disadvantageous because the grid of the lighting fixture will not fit over the fluorescent bulbs, and thus an unsightly box is exposed immediately below the light fixture, and the grate or lens cannot be used to cover the fluorescent bulbs because the box is in the way of the grate.

A further disadvantage with prior power takeoff systems is that they are very complex and require a skilled person to install the takeoff system in a manner in which the system will function adequately due to the variability of ballast types used in fluorescent fixtures. Further, some of the prior art takeoff systems appear to use non-standard length fluorescent light bulbs. When non-standard length fluorescent light bulbs are used, the price of the bulbs is significantly higher than using a standard length bulb.

Clip type devices for drawing power from fluorescent bulb terminals are known. Examples of these type devices are disclosed in U.S. Pat. Nos. 3,582,866; 4,218,106 and 4,511,200. These devices may be unsafe for use in public or retail environments and are unsightly. Therefore, these devices are not suitable for use to power POP displays.

U.S. Pat. No. 5,118,302 discloses a socket system having integral motors. The socket draws power from a fluorescent lamp to operate the motor and animate public displays. This device may be limited with respect to the amount of power it can draw without disadvantageously affecting lighting, and may not be readily adaptable to different fluorescent fixtures either electrically or with respect to the bulky motor box.

U.S. Pat. Nos. 4,912,371; 4,211,958 and 3,993,386 disclose circuitry mounted within dummy fluorescent bulbs or portions to achieve power savings while permitting illumination of the other bulb. These devices do not include means necessary for drawing power, indeed their principle function is power savings.

What is desired, therefore, is a power takeoff unit for a fluorescent fixture which is electrically and mechanically adaptable to varying fixtures for drawing power to operate POP displays in a safe and reliable manner without adversely affecting the appearance and lighting quality of the fixture. A takeoff unit which is modularly designed for easy installation in the fixture and which uses standard fluorescent bulbs is also desired.

Accordingly, it is an object of the invention to provide a takeoff unit for a fluorescent fixture that fits within the space provided for a standard fluorescent bulb. It is a further object of the invention to provide a power take- off unit that does not require an additional box for storing electrical components that hang below the fluorescent lighting fixture in an unsightly manner.

Another object of the invention is to provide the power takeoff device that is modular and can be removed by an unskilled person from one lighting fixture and installed in another lighting fixture at a different location.

Still another object of the invention is to provide a power takeoff device that is not visible once the device is installed in a fixture and the grate or cover of the fixture is put in place.

Yet a further object of the invention is to provide a device wherein once it is installed, all that is visible is a thin power cord tailing down from the fixture to the display or other device requiring power.

SUMMARY OF THE INVENTION

A power takeoff and lighting unit for a fluorescent lighting fixture is provided and comprises a housing having the length of a standard florescent tube. The housing has connectors on opposite ends for electrical connection with connectors of the fluorescent fixture. The housing includes a first segment containing electrical components for converting AC lighting power to usable POP power, such as, for example, 12 VDC. The segment has a power cord extending outwardly from the segment for providing takeoff power. The power takeoff lighting unit preferably includes a second segment on the other end of the housing. The first and second segments both optionally have an internal connector for connection to a smaller standard length fluorescent tube. A spacing sleeve extends between the first and second segments and maintains the segments in spaced apart relation to each other. The combined length of the first and second segments, together with the length of the standard fluorescent tube, is the same length as the fluorescent tube that is to be removed from the fixture. Thus, the power takeoff unit can be placed in the same bulb socket as a standard fluorescent lighting bulb.

In accordance with one aspect of the invention, the sleeve comprises and elongate concave trough having a semi-circular cross section, the trough being sized to receive a standard fluorescent tube. The segments each include a concave trough extending for a predetermined distance laterally outwardly from each segment, the trough having a generally semi-circular cross section. The power takeoff and lighting unit has a diameter that is at most twice the diameter of a conventional fluorescent bulb, and preferably less than about 1½ times the diameter of a standard fluorescent bulb. Because of the small profile of the unit, the power takeoff and lighting unit can replace a conventional fluorescent bulb without a box containing components hanging down from the takeoff unit, as is the case with many prior art power takeoff devices.

One or more of the segments includes an electronic module which safely and reliably converts AC power at a relatively wide frequency range from any of a variety of ballasts to DC power at a voltage suitable for operating small motors and lights used in POP displays. The module includes a rectifier and DC—DC converter. Preferably a high voltage sensor is used to switch a load across the input to prevent fixture start-up voltage spikes from damaging the circuitry. An optional DC ballast may be provided to power a smaller, lower power fluorescent bulb, or it may be powered by the existing ballast in the fixture.

Thus, the power takeoff unit is modular and can be removed by an unskilled person and placed in a different location. Once the power takeoff device is installed, it is not visible, other than a power cord that hangs downwardly out of the fluorescent lighting fixture. Thus, the power takeoff device in accordance with the present invention provides power to operate POP displays in a safe and reliable manner without adversely affecting the appearance and lighting quality of the fixture.

The invention and its particular features and advantages will become more apparent from the following detailed description considered with reference to the accompanying drawings.

DETAILED DESCRIPTION OF THE INVENTION

Figure 1:
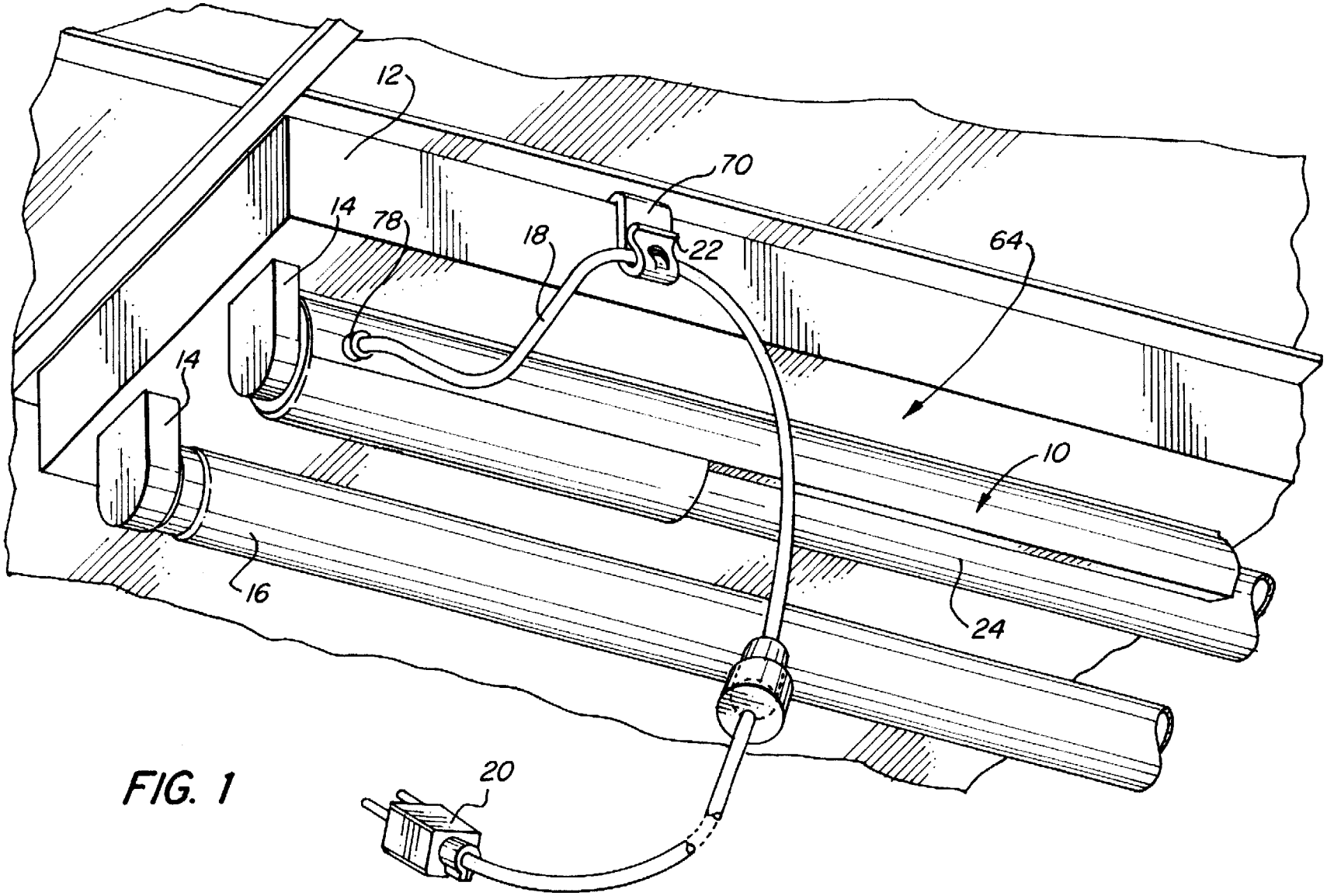
FIG. 1 is an isometric view of a power takeoff and lighting unit in accordance with the invention installed in a fluorescent lighting fixture.
Figure 3:
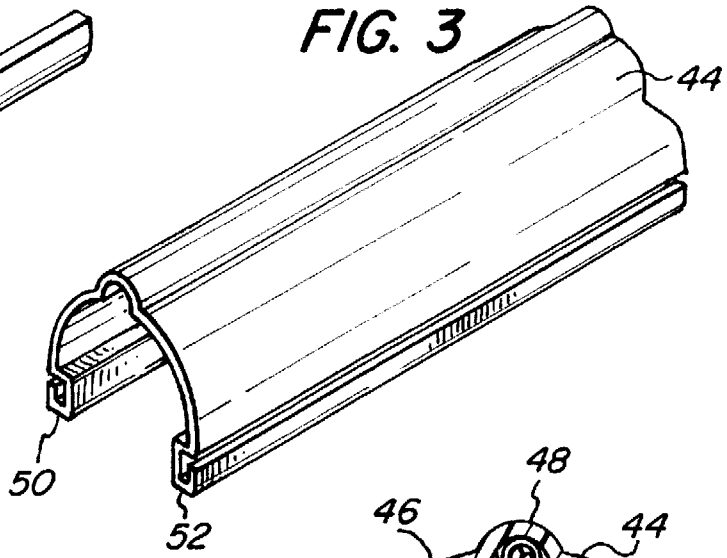
FIG. 3 is an isometric view of a section of the housing of the power takeoff and lighting unit of FIG. 1.
Figure 2:
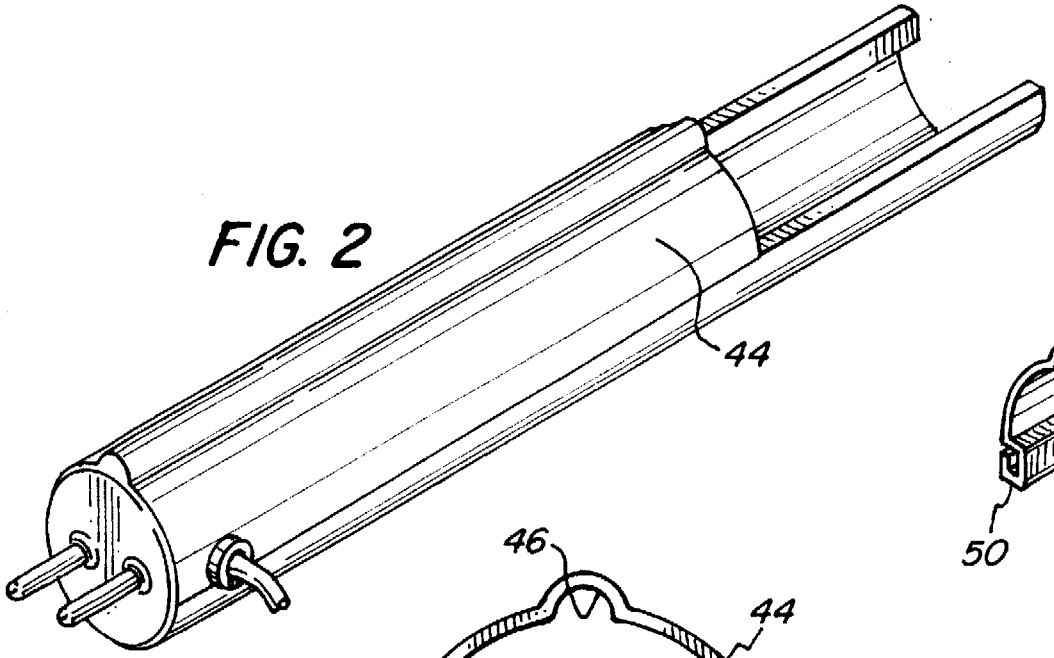
FIG. 2 is an isometric view of one end of a power take off and lighting unit of FIG. 1 with the fluorescent bulb removed.

Referring to FIG. 1, a power takeoff and lighting unit 10 is shown in isometric view and is installed in a conventional fluorescent lighting fixture 12 of the type having a power connector 14 for receiving the prong or prongs of a conventional fluorescent bulb 16. As can be appreciated by one skilled in the art, a standard fluorescent bulb 16 is manufactured in various lengths, such as, for example, 4-foot, 6-foot, and 8-foot lengths. The connectors 14 are spaced apart a predetermined distance to accept a bulb having a standard length. For example, in the fluorescent fixture shown in FIG. 1, the length of bulb 16 may be 8 feet long and the distance between connector 14 on the left hand side and another connector (not shown) on the right hand side is approximately 8 feet.

In accordance with the present invention, a conventional 8-foot long bulb is removed from fixture 12 and power takeoff and lighting unit 10 is installed in its place. More specifically, the unit 10 has a length approximating the length of a standard bulb, and the bulb is simply removed and unit 10 installed in its exact location. As shown in FIG. 1, the unit 10 has the same general appearance and size as the adjacent fluorescent bulb 16. The unit 10 includes a power cord 18 that permits power to be drawn from the lighting fixture 12 and delivered through power cord 18 to an electrical connector 20, which powers a POP device such as a lighting fixture or a motorized display or other device requiring power.

Because the unit 10 fits in substantially the same space as does a conventional fluorescent bulb, the profile of the unit is the same as a conventional bulb, and the lighting fixture can be covered in a conventional manner with a grate or other mechanism, not shown in the drawings. The ability to flush mount unit 10 is desirable because in a retail or commercial environment, the aesthetics of the lighting are very important, and it is desirable to be able to finish the ceiling without a motor or electrical box hanging in plain view. A clip 22 holds the power cord up and out of the way and permits the power cord 18 to drape downwardly in a controlled fashion. The power cord 18 can be threaded through a grate or to the edge of the cover for the lighting fixture so that a person viewing the lighting fixture only sees a thin power cord extending downwardly from the fixture.

As shown in FIG. 1, the unit 10 includes a fluorescent bulb 24 which is somewhat smaller in length than bulb 16 but provides ample lighting so that a viewer does not visually sense the omission of a bulb or that a bulb is unlit because it has malfunctioned. While bulb 24 may be slightly less luminous than bulb 16 because of its length and/or lower power requirement, it provides an ample amount of light so that the viewer does not visually detect a difference.

Figure 6:
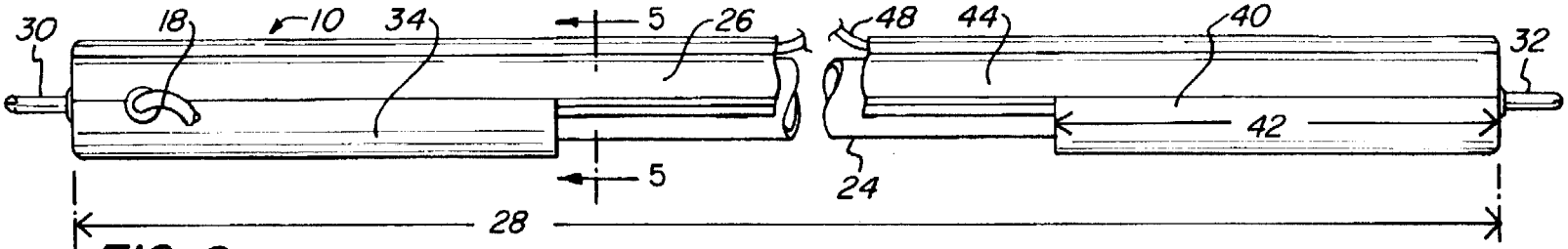
FIG. 6 is a side elevation view of a power takeoff and lighting unit of FIG. 1.

Referring in particular to FIGS. 1 and 6, the power takeoff and lighting unit will now be described in detail. The unit has a housing 26 that has the length 28 of a fluorescent bulb having a standard length. More specifically, in the example described with respect to FIGS. 1 and 6, the length of unit 10 is approximately 8 feet. The housing 26 has electrical connectors 30 and 32 for connection to the connectors 14 of a conventional fluorescent lighting fixture 12. A conventional fluorescent bulb typically has a two prong connector, and this type of connector is shown with the unit 10 described in the drawings. However, it should be understood that any type of connection can be used, such as a single prong connection, a multiple prong connection, and connections having shapes that are other than prongs. The power takeoff unit 10 includes connectors that are suited to match the connectors of the bulbs that the unit is replacing.

Figure 7:
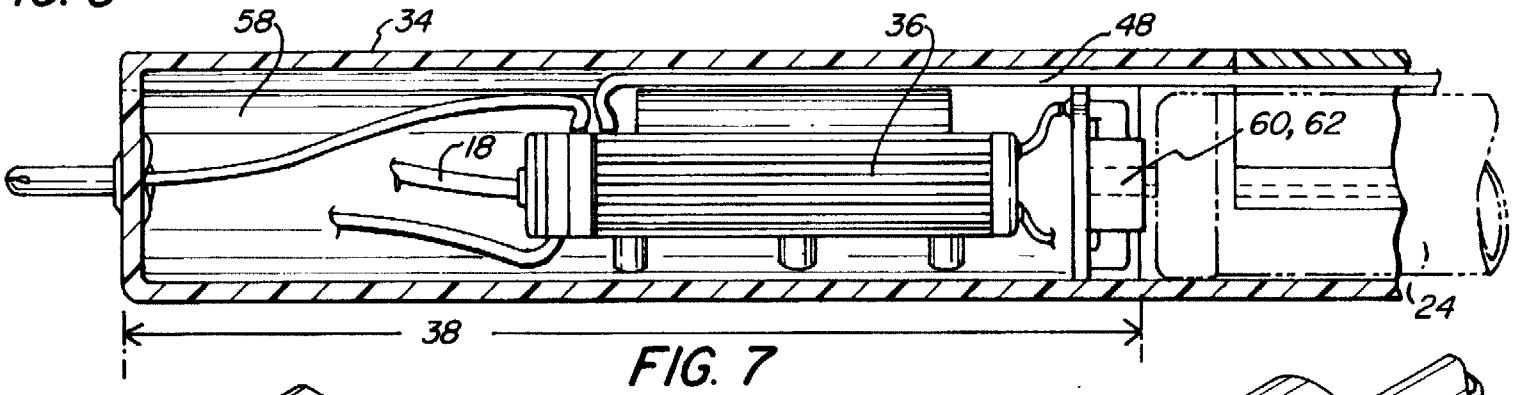
FIG. 7 is a partial sectional view of one end of the power takeoff and lighting unit of FIG. 1 illustrating the electronic module.

Referring to FIGS. 1, 6 and 7, the housing 26 includes a first segment 34 containing electrical components for taking off power from the system which powers the lighting fixture 12 and delivering the power to a POP display via electrical conduit 18. As shown in FIG. 7, segment 34 includes an electronic module 36 for converting the alternating current of the main power system which may vary in frequency from about 50 Hz to about 60 Hz and may vary in voltage from below 110 VAC RMS to above 240 VAC RMS into a direct current at a voltage level suitable for use with the POP display. Additionally, module 36 is capable of providing the suitable DC voltage without regard to the type of ballast in fixture 12 which may be provided in magnetic or electric form having output at frequencies from below 50 Hz to beyond 25 kHz. It is understood that segment 40 may also include an electronic module. As shown in FIG. 7, the segment 34 has a length 38. Referring to FIG. 6, segment 40 has a length 42. In the preferred form of the invention, the segments 34 and 40 are sized so that the optional, smaller size bulb 24 which may be inserted in unit 10 has a length that is standard. More specifically, assuming that bulb 16 is a conventional 8-foot fluorescent bulb, segment 34 and segment 40 each have a length of one foot so that a 6-foot bulb can be used in unit 10. This example can be used to size a wide variety of takeoff units. More specifically, if a takeoff unit were being built for use in replacement of a 6-foot bulb, the segments 34 and 40 would each have a length of one foot, and a conventional 4-foot fluorescent bulb would be used. The principle could also be applied to fluorescent fixtures and bulbs designed under the metric system. It is possible, however, to design a fixture so that a non-standard length bulb is used in lighting unit 10. Further, it is also possible to utilize a non-fluorescent lighting source having a length that would fit within the space provided in the unit.

It is desirable to provide a spacing sleeve 44 extending the distance between the first segment 34 and the second segment 40, the spacing sleeve maintaining the segments in spaced apart relation to each other. The power takeoff lighting unit 10 is modular in design which permits a conventional fluorescent bulb of varying size to be removed from a lighting fixture having electronic or magnetic ballast and replaced with the unit 10 by a relatively unskilled person. The person need not be an electrician, but rather, can simply be a person of sufficient skill to replace an ordinary light bulb.

Figure 5:
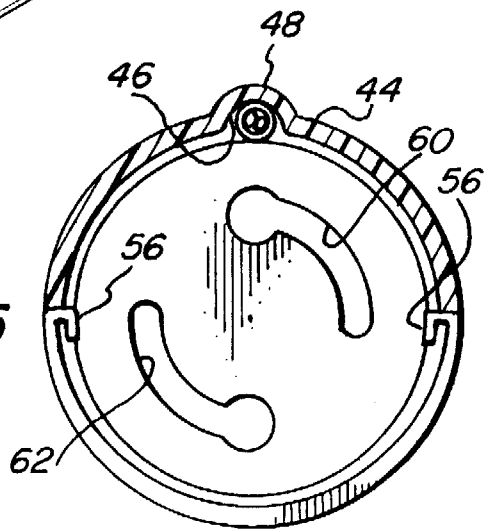
FIG. 5 is an interior view of the power takeoff and lighting unit of FIG. 1 with the housing sectioned away to expose the socket for a conventional fluorescent bulb.

As shown particularly well in FIGS. 5, 6 and 7, an electrical conduit or wire may run along a channel 46 formed or otherwise extruded into the spacing sleeve 44. Although only 1 is shown, it is understood that multiple channels 46 may be provided. More specifically, as shown particularly well in FIGS. 2–5, the spacing sleeve 44 has a channel 46 integrally formed in the sleeve. Channel 46 has routed therein one or more wire connector(s) 48 which permits electrical connection between segment 34 and segment 40. This electric connection provides for powering electronic module 36, and may also be used to illuminate optional bulb 24, or provide for a second power takeoff cord if necessary.

Figure 4:
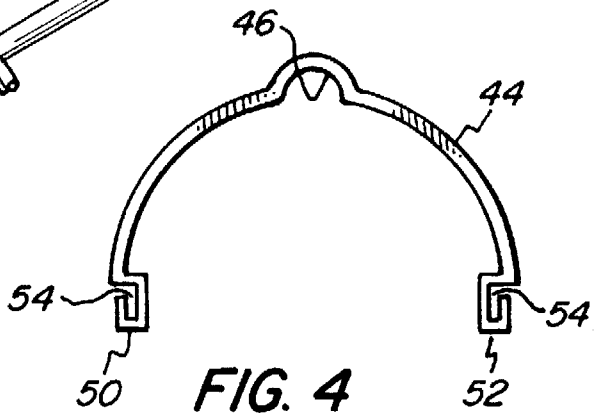
FIG. 4 is an end view of the portion of the housing shown in FIG. 3.

In accordance with a preferred aspect of the present invention, the spacing sleeve is extruded from aluminum or plastic material (if sufficiently heat resistant) and has a uniform cross section. The sleeve comprises an elongate concave trough having a generally semi-circular cross section. Although not shown, the sleeve may include structural ribs and or vanes for heat dissipation. The sleeve includes a pair of rails 50 and 52 having an interlocking mechanism 54 which locks with a companion locking mechanism 56 on the segments 34 and 40. More specifically, as shown in FIG. 5, the segments 34 and 40 also comprise an elongate concave trough having a generally semi-circular cross section. The concave trough has a pair of rails terminating in hooks 56. The hooks 56 are placed in and slid into interlocking mechanisms 54. The interlocking mechanisms shown in FIGS. 4 and 5 provide a slidable male member which interlocks with a slidable female member which receives the male member and locks the two semi-circular components together to form a cavity 58 (best shown in FIG. 7) for storing electrical and/or computer components in electronic module 36.

FIG. 5 shows a view along the plane 5—5 of FIG. 6, except that smaller bulb 24 has been removed to expose sockets 60 and 62, which are conventionally designed sockets for a fluorescent fixture.

Referring to FIG. 6, the unit 10 has a relatively low profile. As shown in FIG. 1, the unit 10 replaces a conventional lighting fixture and has a diameter slightly larger than the diameter of a conventional lighting fixture. In most fluorescent lighting fixture, there is a small amount of space 64 between the standard bulb and the inside of the fixture. This is typically a distance of between about ¼ inch and about 1 inch and provides space for the sleeve 44. In accordance with a preferred aspect of the invention, the maximum diameter of the unit 10 is less than about twice the diameter of a standard fluorescent bulb. In a most preferred embodiment of the invention, the maximum diameter of the unit is less than about 1½ times the diameter of a standard bulb. By providing a relatively compact power takeoff unit, the unit can be exchanged with a standard bulb. By providing a modular approach to this power takeoff unit having a relatively low profile, the power takeoff device can be hidden in a lighting fixture and appear to untrained eyes as simply another bulb. This provides the multiple advantages of having a safe power takeoff device that is aesthetically pleasing.

Figure 8:
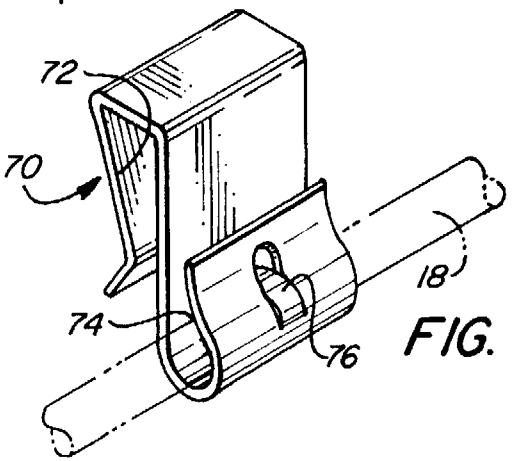
FIG. 8 is an enlarged isometric view of the power cord clip shown in FIG. 1.

Referring to FIGS. 1 and 8, a clip for supporting the power cord 18 will now be described. The clip is preferably made from deformed metal. The clip 70 includes a U-shaped spring loaded bracket 72 for installation on a fixture. The other end of the clip 70 includes a receptacle 74 for receiving cord 18. The receptacle may include a bent metal retainer 76 that holds the wire in place. As shown in FIG. 1, the clip 70 holds the power cord 18 in place and provides a small amount of slack between clip 70 and the exit area 78 on the unit where the power cord 18 emerges from the unit to prevent accidental disconnection of the cord from module 36.

Figure 9:
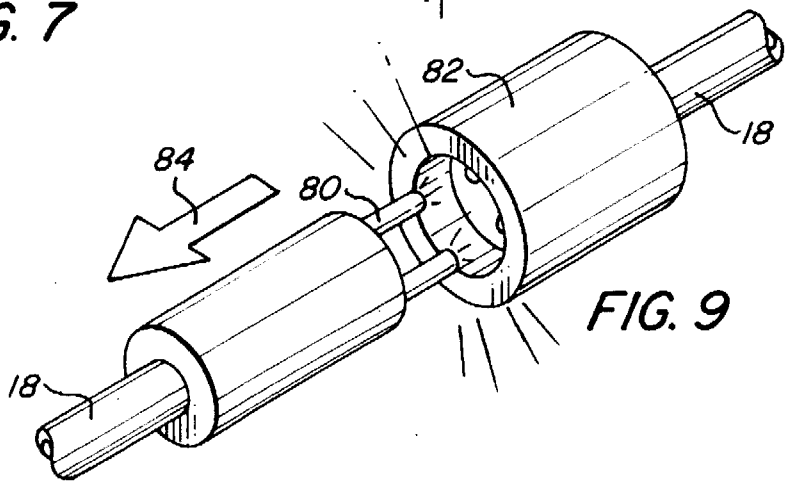
FIG. 9 is an enlarged isometric view of the quick disconnect device shown in FIG. 1.

Referring to FIGS. 1 and 9, the quick disconnect device will now be shown and described. The quick disconnect device includes a plug 80 and a receptacle 82. If the cord is tugged from the bottom, plug 80 will break away from the receptacle 82 as shown by arrow 84 to prevent damage to or removal of unit 10 from fixture 12 which might otherwise cause injury in a POP location.

Figure 10:
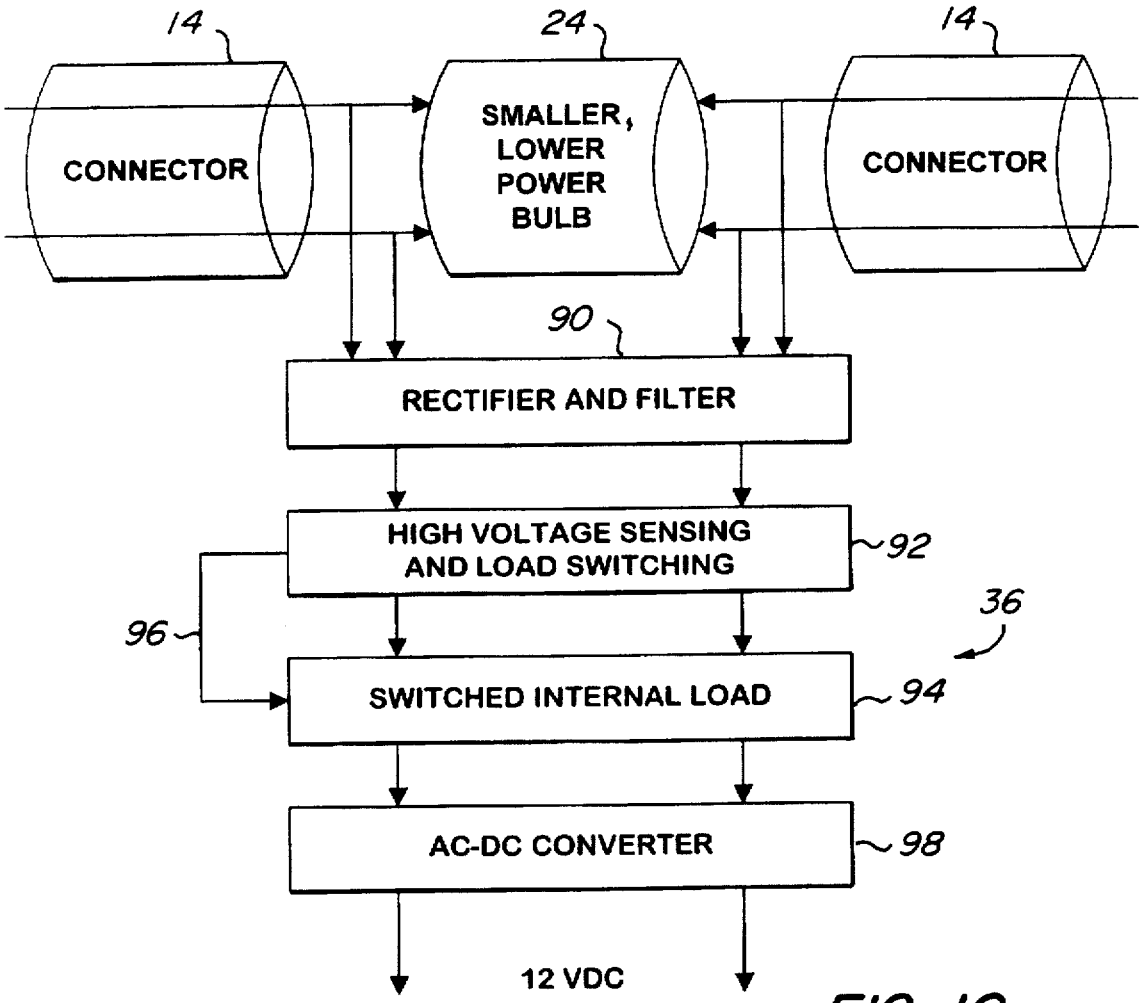
FIG. 10 is a functional block diagram of the electronic module components of the power takeoff and lighting unit of FIG. 1 including an optional smaller, lower power bulb.
Figure 11:
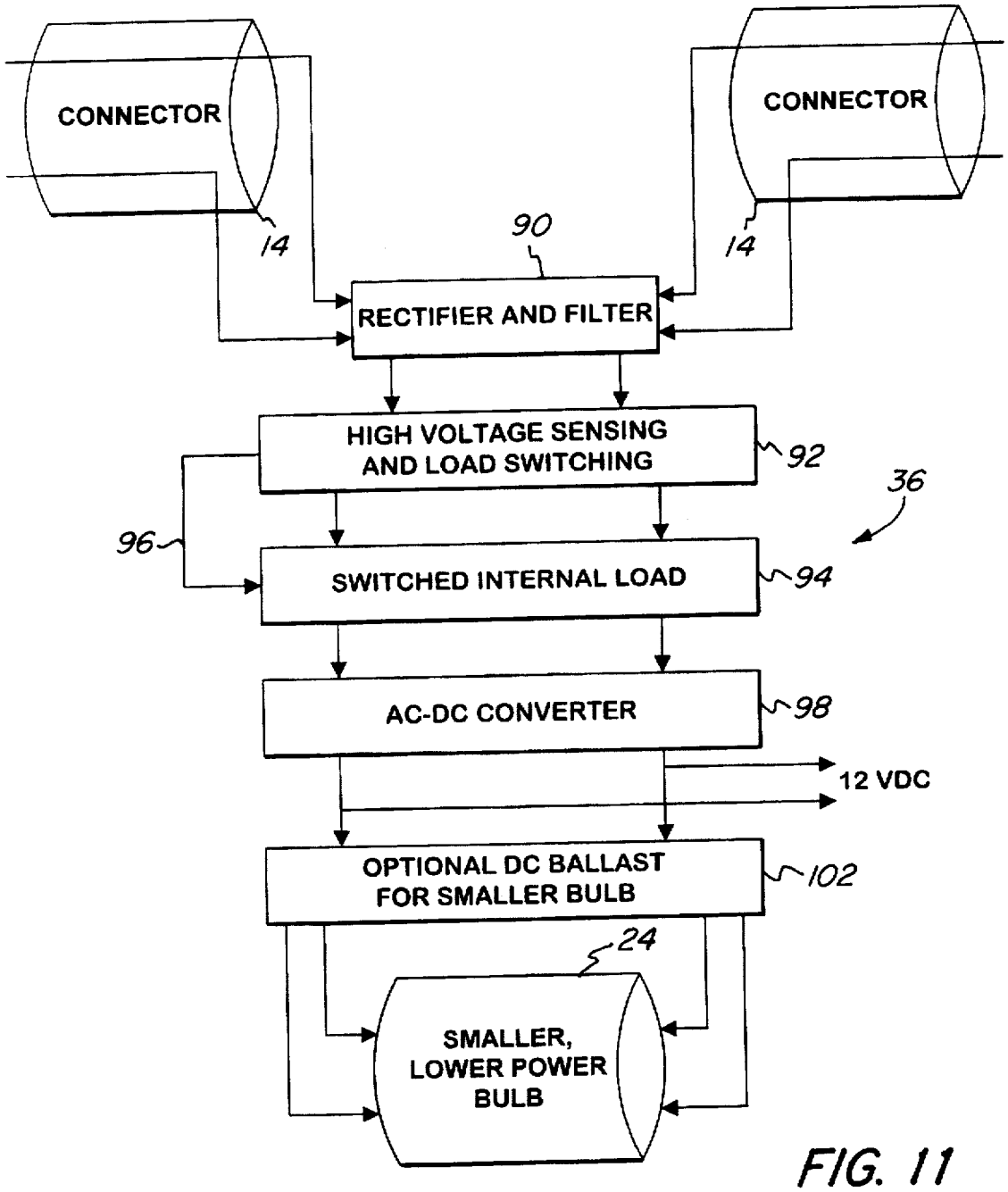
FIG. 11 is a functional block diagram of the electronic module components of the power takeoff and lighting unit of FIG. 1 including an optional DC ballast.

Referring now to FIGS. 10 and 11, the functional components of electronic module 36 can be described in additional detail. As illustrated in both Figures, module 36 includes a rectifier 90, high voltage sensing and load switching circuitry 92, an internal load 94 switchable by circuitry 92 along line 96, and a DC—DC converter 98 to step the voltage down to a safe level, e.g., 12 VDC. Rectifier 90 converts fixture ballast output at frequencies from below 50 Hz to beyond 25 kHz depending upon the type of ballast employed in fixture 12 so that unit 10 is functional in virtually any fixture. Sensing circuitry 92 switches load 94 to limit excessive voltages which are likely to occur during lighting of fixture 12. Excessive voltage is detected by comparing an output voltage of the rectifier to a reference voltage in determination of whether to apply internal load 94 to safeguard system components.

Particularly with reference to FIG. 10, where a smaller, lower power bulb 24 is desired to be used, it may be powered directly from the ballast in fixture 12 on the AC side of rectifier 90. Since bulb 24 draws less power than the larger bulb it replaces, sufficient energy is available for conversion to DC.

Now, with particular reference to FIG. 11, use of smaller bulb 24 may also be enabled with a DC ballast 102 wired on the DC side of rectifier 90. Although not illustrated in either of FIGS. 10 or 11, the 12 VDC output of module 36 may be used to operate a small internal cooling fan to prevent overheating of the circuit components.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A power takeoff and lighting unit for a fluorescent lighting fixture for extracting power and for providing takeoff power, said fixture being of the type having laterally spaced ends, each end including an electrical connector for connection to connectors on the end of a first fluorescent lighting tube having a standard length, said connector ends being spaced apart a predetermined distance to receive said first fluorescent tube, said unit lighting by use of a second standard fluorescent tube having a length less than the first tube length, said second tube having two ends, the takeoff unit comprising:

a housing having the length of said standard fluorescent tube length, said housing having spaced apart connectors on opposite ends for electrical connection with said connectors of said fluorescent fixture, said housing including a first segment containing electronics for converting said power to direct current, said segment having a power cord extending outwardly from the segment for providing said takeoff power;

said first segment including a connector for connecting to one said end of the second standard fluorescent tube;

a second segment having a connector for connection to said other end of the second standard fluorescent tube;

both said segments having a combined length, the difference between said length of the standard fluorescent tube and said combined length approximating said length of a second standard fluorescent tube;

a spacing sleeve extending the distance between said first and second segments for maintaining said segments in spaced apart relation to each other, said sleeve having a length, said sleeve length and said combined length of said first and second segments equalling said length of said first standard fluorescent tube.

2. A unit according to claim 1 wherein said segments have a generally cylindrical shape and wherein the length of the first segment is approximately equal to the length of the second segment.

3. A unit according to claim 2 wherein said segments are interchangeable.

4. A unit according to claim 3 wherein said segments have a diameter approximating a standard fluorescent tube diameter, said unit fitting in said fixture between said laterally spaced ends of the fixture.

5. A unit according to claim 1 wherein a wire extends between said first and said second segments for transmitting power therebetween.

6. A unit according to claim 1 wherein the electronics include a rectifier for converting AC to DC to achieve compatibility with magnetic and electric ballasts.

7. A unit according to claim 1 wherein said sleeve comprises an elongate concave trough having a generally semi-circular cross section, said trough receiving said second fluorescent tube.

8. A unit according to claim 7 wherein each said segment includes a concave trough extending for a predetermined distance laterally outwardly from each said segment, said trough having a generally semi-circular cross section for receiving an end of said second lighting tube.

9. A unit according to claim 8 wherein said trough of each said segment includes a pair of rails, and wherein the trough of said sleeve includes at opposite ends thereof a pair of rails, said rails of said sleeve trough having a mechanism for interlocking with the rails of said segment trough to form an integral unit housing the second fluorescent tube.

10. A unit according to claim 9 wherein one pair of rails of either the sleeve trough or the segment trough comprises a slidable male member and wherein the other pair of rails comprises a slidable female member for receiving the slidable male of the one pair of rails.

11. A unit according to claim 1 wherein said first segment contains a switch having at least two positions, one position delivering power to said second tube for lighting and to said takeoff power cord, said switch including a second position for terminating power to said second lighting tube and delivering power to said takeoff cord.

12. A unit according to claim 1 wherein said takeoff power cord includes a disconnect mechanism for disconnecting the unit if said cord is inadvertently pulled, said mechanism comprising a female and male connector positioned in said takeoff cord, said male/female connector separating when a predetermined force is imposed on said cord.

13. A unit according to claim 12 and further including a clip for anchoring said takeoff cord, said clip being attached to said takeoff cord at a location between said first segment and said disconnect mechanism, said clip including means for releasably securing said power cord to said fixture, said clip releasing said fixture when a predetermine force is imposed on the cord.

14. A unit according to claim 1 wherein said sleeve comprises:

an elongate concave trough having a generally semi-circular cross section and wherein each said segment includes a concave trough extending for a predetermined distance laterally outwardly from each said segment, said trough having a generally semi-circular cross section for receiving an end of said second lighting tube, said trough of each said segment including a pair of rails, and the trough of said sleeve including at opposite ends thereof a pair of rails, said rails of said sleeve trough having a mechanism for interlocking with the rails of each said segment trough to form a pair of cavities for retaining the end portions of said second fluorescent tube, each cavity having a circular cross section defined by the sleeve trough and the segment trough and having a depth for fully encompassing the end portions of the second fluorescent tube.

15. A unit according to claim 14 wherein said first and second segments have a cylindrical shape having a diameter slightly larger than the diameter of said standard fluorescent bulb, and wherein said concave trough of each said segment extends laterally outwardly from its respective segment and has a diameter equal to the diameter of its respective cylindrical segment, said elongate sleeve trough having a diameter slightly larger than said standard diameter of the fluorescent tube, and wherein the diameter of the sleeve trough is equal to the diameter of each trough segment, to provide said cavity having a diameter slightly larger than the fluorescent tube diameter.

16. A unit according to claim 15 wherein said segment has an outer cylindrical surface coincident with the outer cylindrical surface of its associated trough, the surface of the trough merging seamlessly with the surface of the cylindrical segment.

17. A power takeoff unit for a fluorescent lighting fixture for extracting power and for providing takeoff power directly to an appliance, said fixture being of the type having laterally spaced ends, each end including an electrical connector for connection to connectors on the end of a first fluorescent lighting tube having a standard length and a standard diameter, said connector ends being spaced apart a predetermined distance to receive said first fluorescent tube, the takeoff unit comprising:

a housing having the length of said standard fluorescent tube length, said housing having spaced apart connectors on opposite ends for electrical connection with said connectors of said fluorescent fixture, said housing including a first segment, said segment containing an electronic module for converting said power to direct current, a power cord extending outwardly from the segment for providing said takeoff power to said appliance without further conversion, said segment having a cylindrical shape having a diameter approximating the standard bulb diameter;

a spacing sleeve extending the distance between said first segment and one of the spaced ends of the fixture, said sleeve having a length, said sleeve length and the length of said first segment equalling said length and approximating the diameter of said first standard fluorescent tube permitting the unit to be interchanged with a standard fluorescent tube installed in the fixture.

18. The power takeoff unit of claim 17 wherein the electronic module includes a rectifier for converting AC at frequencies between below 50 Hz to above 25 kHz into DC to achieve compatibility with fixtures having either electric or magnetic ballasts.

19. The power takeoff unit of claim 18 wherein a main power supply for the fluorescent lighting fixture ranges from below 110 VAC RMS to above 240 VAC RMS at 50 Hz to 60 Hz.

20. A power takeoff unit for a fluorescent lighting fixture for extracting power and for providing takeoff power, said fixture being of the type having laterally spaced ends, each end including an electrical connector, the unit comprising:

an elongate housing, said housing having spaced apart connectors on opposite ends for electrical connection with said connectors of said fluorescent fixture, said housing including a first segment containing a rectifier and DC—DC converter for converting said power to usable DC, said segment having a power cord extending outwardly from the segment for providing said takeoff power;

said first segment having a generally cylindrical shape and including a connector for the fluorescent tube;

said housing having a maximum diameter less than twice the diameter of the bulb to provide a compact profile and a modular unit for insertion into the fixture.

21. The power takeoff unit of claim 20 including a fluorescent lighting tube mounted within the housing and a ballast mounted within said first segment for lighting said tube.

* * * * *